US007189947B2

(12) United States Patent
Fulton

(10) Patent No.: US 7,189,947 B2
(45) Date of Patent: Mar. 13, 2007

(54) OVEN TEMPERATURE CONTROL

(75) Inventor: Steven J. Fulton, Elgin, IL (US)

(73) Assignee: Emerson Electric Co., St. Louis, MO (US)

( * ) Notice: Subject to any disclaimer, the term of this patent is extended or adjusted under 35 U.S.C. 154(b) by 91 days.

(21) Appl. No.: 10/365,941

(22) Filed: Feb. 13, 2003

(65) Prior Publication Data

US 2003/0218002 A1 Nov. 27, 2003

Related U.S. Application Data

(60) Provisional application No. 60/356,444, filed on Feb. 13, 2002.

(51) Int. Cl.
*H05B 1/02* (2006.01)

(52) U.S. Cl. ..... 219/490; 219/492; 219/412; 374/120

(58) Field of Classification Search ..... 219/507, 219/508, 494, 497, 501, 506, 411–414, 505; 374/120, 121, 101, 102; 307/117, 39–41
See application file for complete search history.

(56) References Cited

U.S. PATENT DOCUMENTS

| | | | | | |
|---|---|---|---|---|---|
| 4,010,412 | A * | 3/1977 | Forman | ..... | 219/497 |
| 4,333,002 | A * | 6/1982 | Kozak | ..... | 392/451 |
| 4,405,855 | A * | 9/1983 | Kolle et al. | ..... | 219/501 |
| 4,506,146 | A * | 3/1985 | Rice et al. | ..... | 219/499 |
| 5,981,916 | A * | 11/1999 | Griffiths et al. | ..... | 219/492 |
| 6,091,060 | A * | 7/2000 | Getchel et al. | ..... | 219/483 |
| 6,495,806 | B2 * | 12/2002 | Siefert | ..... | 219/494 |
| 6,818,012 | B2 * | 11/2004 | Ellingboe | ..... | 607/104 |

* cited by examiner

*Primary Examiner*—Mark Paschall
(74) *Attorney, Agent, or Firm*—Locke Liddell & Sapp LLP

(57) ABSTRACT

A control system for controlling an appliance at a predetermined temperature. The control system comprises a sensor capable of providing a temperature signal representative of a temperature in the appliance and a controller capable of receiving the temperature signal and determining an amount of time to apply power based on the temperature signal. The amount of time to apply power is a percentage of time to apply power of a predetermined time period.

8 Claims, 4 Drawing Sheets

OVEN TEMPERATURE CONTROL

CROSS-REFERENCE TO RELATED APPLICATIONS

This application claims priority to U.S. Provisional Patent Application Ser. No. 60/356,444, filed on Feb. 13, 2002, and having the same title and inventor as the present application.

BACKGROUND OF THE INVENTION

The invention relates to control systems for appliances. Specifically, the invention involves a control system that provides high precision temperature control.

A conventional household oven allows a user to set a temperature for baking or cooking food. The oven heats an oven chamber to the desired temperature and attempts to maintain that temperature in the oven chamber for the duration of the cooking period. To heat the oven and maintain the oven temperature, the conventional household oven includes heating elements, a temperature sensor, and a controller. For the oven's basic operation, the heating elements are supplied with power to heat the oven chamber. The temperature sensor supplies a signal that indicates the temperature within the oven chamber. When the temperature sensor indicates to the controller that the temperature within the oven chamber reaches the desired temperature, the controller removes the power from the heating elements. The controller later applies additional power to the heating elements when the temperature sensor indicates that the temperature within the oven chamber falls below the desired temperature.

A common control method for maintaining the temperature within the oven chamber is thermostat-style trip point detection with hysteresis. With this method, the heating elements are provided with power until the temperature sensor reads an upper trip point temperature. Typically, the heating elements are driven fully on using relays. Then, the heating elements are turned off using the relays and remain off allowing the oven chamber cools until the sensor reads a lower trip point temperature. Once the lower trip point temperature is reached, the heating elements are again energized repeating the method. For the typical household oven, the temperature sensor is a standard resistive temperature device (RTD) sensor. The temperature sensor is typically mounted in the corner of the oven chamber. The temperature sensor supplies the signal to the controller that reads the oven temperature with a precision of about two degrees Fahrenheit.

One shortcoming of the thermostat-style trip point detection method is that the temperature at the center of the oven may vary significantly. Because the temperature sensor is located on the cavity wall of the oven chamber a lag in the temperature reading occurs. The center of the oven chamber can experience large temperature swings while the temperature sensor reads only small changes in temperature. Improving the performance of the thermostat-style trip point detection method requires better thermal isolation of temperature sensor or a higher precision measurement of the temperature sensor. However, these solutions add significant costs to the oven appliance.

Thus, there is needed a control system for maintaining the temperature within a small range within the oven chamber. The system should use a simple temperature sensor and cost-effective electronic components that do not depend on small fluctuations in the temperature sensor input to determine when to apply heat.

SUMMARY OF THE INVENTION

According to one aspect of the present invention, there is provided a control system for controlling an appliance at a predetermine temperature. The control system comprises a sensor capable of providing a temperature signal representative of a temperature in the appliance and a controller capable of receiving the temperature signal and determining an amount of time to apply power based on the temperature signal. The amount of time to apply power is a percentage of time to apply power of a predetermined time period. The controller determines an error value representing the difference between a sensed temperature provided by the temperature signal and the predetermined temperature. The controller determines the percentage of time to apply power for a predetermined time period based on the error value. The controller may also use a sum of the error values and the rate of change of the error values to determine the percentage of time to apply power of a predetermined time period.

According to another aspect of the present invention, there is provided a method for controlling an appliance at a predetermined temperature. The method comprising the steps of determining an appliance temperature, calculating a difference between the predetermined temperature and the appliance temperature, calculating a percentage output value using the difference, and supplying power to the appliance for a percentage of time equal to the percentage output value of a predetermined time period.

According to a further aspect of the present invention, there is provided a control system for controlling an appliance at a predetermine temperature comprising a sensor capable of providing a temperature signal representative of a sensed temperature in the appliance, a first heat element capable of providing heat in the appliance when supplied with power and a controller capable of receiving the temperature signal and determining a percentage of time of a predetermined time period to apply the power to the first heating element based a difference between the sensed temperature and the predetermined temperature the controller implements a proportional-plus-integral-plus-derivative regulator to determine the percentage of time to apply the power. The control system may also include a second heating element. The controller may execute a heating profile by supplying power to the first heating element for a first fixed time and supplying power to the second heating element for a second fixed time. The controller varies an amount of time without supplying power to the heating elements based on a difference between one hundred percent and the percentage of time to apply the power.

BRIEF DESCRIPTION OF THE DRAWINGS

Other objects and advantages of the invention will become apparent upon reading the following detailed description and upon reference to the drawings.

Figure 1:
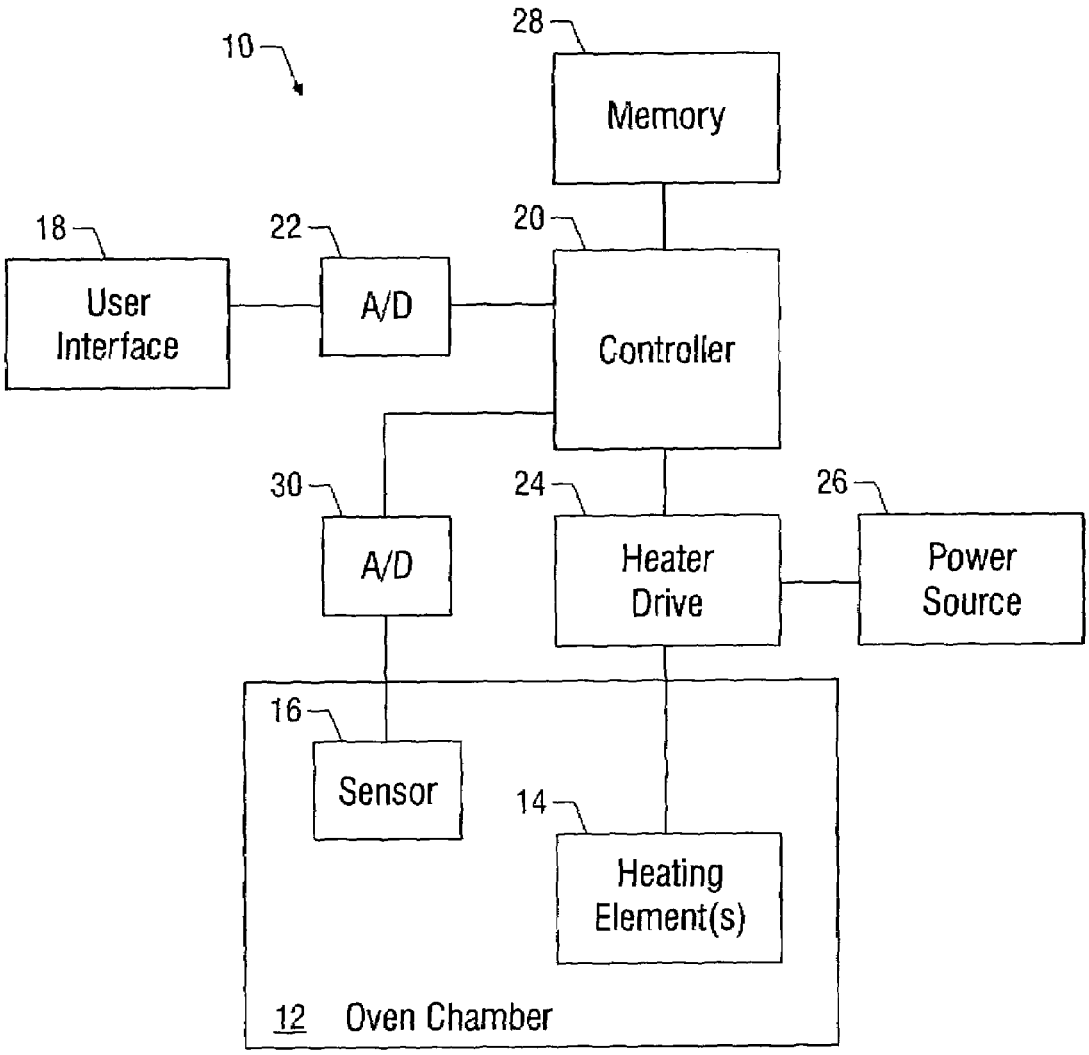
FIG. 1 is a block diagram of a household electric oven.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Although the following description is in terms of a control system for an oven, it will be understood by those skilled in the art that it is applicable to all types of appliances including all types of ovens, refrigerators, freezers, washers, dryers and dishwashers.

Turning to FIG. 1, a block diagram of a household electric oven 10 according to one embodiment of the present invention. The oven comprises an oven chamber 12 having at least one heating element 14 and a temperature sensor 16. The oven 10 also has a user interface 18 that allows the user to control the operation of the oven 10. The user interface 18 is a typical interface on the front of a typical household oven. The interface 18 comprises a keypad with keys and/or dials that turn the oven on and off. Additionally, the keys and/or dials present on the user interface 18 instruct the oven to operate at particular temperature set point and operational mode. For example, the user selects the appropriate temperature set point for the oven chamber 12, such as 350° F., and selects the operating mode, such as bake mode, self-cleaning mode and defrost mode, with the user interface 18.

The user interface 18 generates signals indicating pressed keys and/or dial positions. These signals are transmitted from the user interface 18 to a controller 20 through an analog-to-digital converter 22. The analog-to-digital converter 22 receives the analog signals from the user interface 18 and transforms them into digital signals that are readable by the controller 20. Although shown as separate elements, the analog-to-digital conversion can be done internally at the controller 20 if it is the type of a microcomputer or microprocessor equipped for such a purpose.

The controller 20 receives and processes the signals from the user interface 18 through the analog-to-digital converter 22. The controller 20 may be a microcomputer or any other processors known to those skilled in the art. The processing results in a series of control signals being sent from the controller 20 to other elements of the oven to operate the oven at the desired oven temperature and in the desired oven mode. The controller 20 sends control signals to a heater drive 24 that transmits power from a power source 26 to the heater elements 14. The controller 20 may also send control signals to other elements of the oven, such as a fan, depending on the oven mode.

The controller 20 also receives signals representing information stored in a memory 28. Upon request, the memory 28 transmits its stored information signals to the controller 20. In an alternative embodiment, the controller 20 includes a nonvolatile memory. The memory 28 stores information representing various parameters in the oven's modes of operation. The controller 20 requests the information stored in memory 28 based on the signal inputs received from the user interface 18. For example, if the user has selected the self-cleaning mode with the user interface 18, the controller 20 obtains information from the memory 28 relating to the self-cleaning mode.

The controller 20 also receives a signal representing an oven chamber temperature from the temperature sensor 16. The temperature sensor 16 is a standard resistive temperature device (RTD) sensor or any other temperature sensor known to those skilled in the art. The temperature signal is transmitted from the temperature sensor 16 to the controller 20 through an analog-to-digital converter 30. The temperature signal may be filtered for noise prior to be sent to the analog-to-digital converter 30 as known to those of ordinary skill in the art. The analog-to-digital converter 30 receives the analog signal from the temperature sensor 16 and transforms it into digital signals that arc readable by the controller 20. Although shown as separate elements, the analog-to-digital conversion can be done internally at the controller 20 if it is the type of a microprocessor equipped for such a purpose. The controller 20 uses the signals from the temperature sensor 14 to determine the temperature in the oven chamber 12 as known to those skilled in the art.

Figure 2:
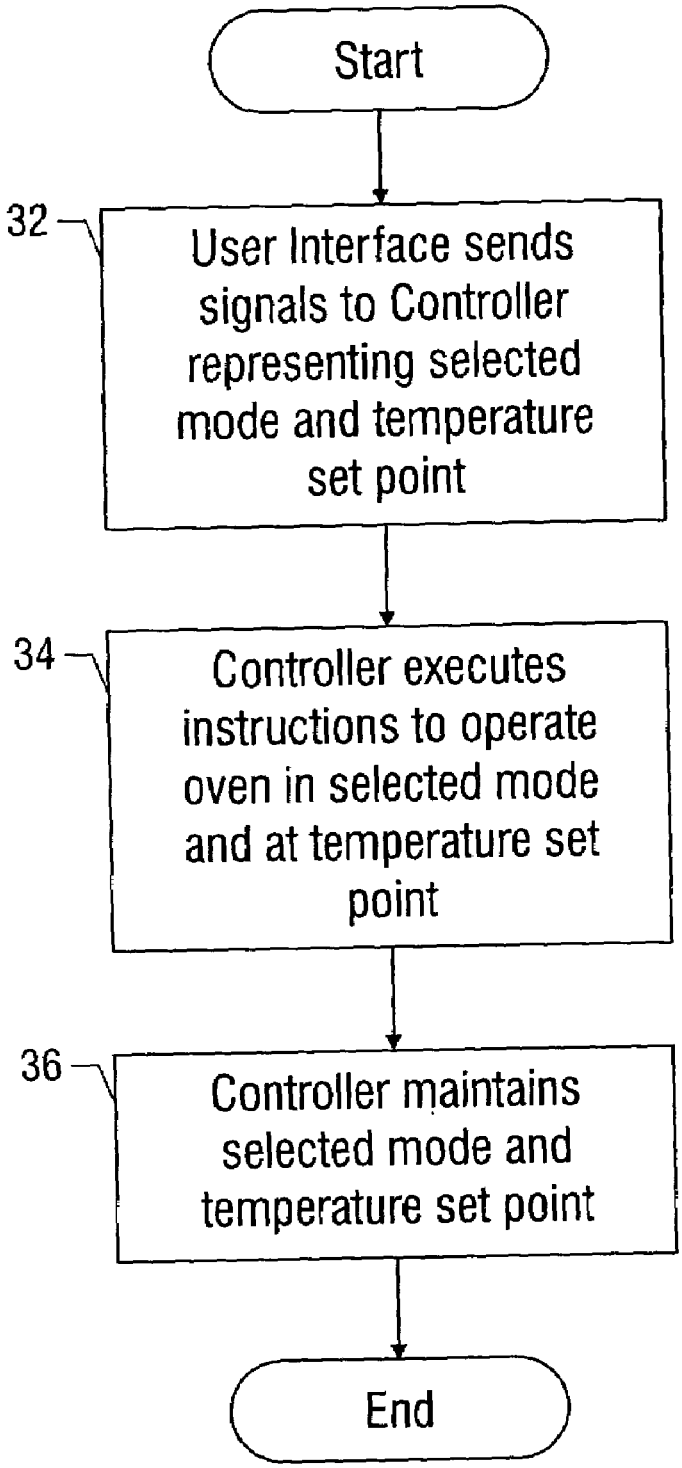
FIG. 2 is a flowchart of the operation of the oven in FIG. 1.

FIG. 2 illustrates the basic operation of the oven. First, the user selects a desired oven mode and oven temperature set point on the user interface 18. Based on the user selections, the user interface 18 sends signals indicating the desired oven mode and desired oven temperature set point to the controller 20 at step 32. For example, the user may select the baking mode with the desired temperature set point of 350 degrees Fahrenheit, and the user interface 18 sends signals to the controller 20 indicating the bake mode and 350° F. temperature set point. Once the controller 20 receives these signals, the controller 20 executes instructions to operate the oven in the selected mode and at the selected temperature set point at step 34. Typically, the controller 20 will signal the heater drive 24 to supply power to the heating elements 14 to heat the oven chamber to the desired temperature set point. Next at step 36, the controller 20 maintains the selected oven mode operation and maintains the selected temperature set point. Typically, the controller 20 monitors the temperature of the oven chamber 12 using the temperature sensor signal and signals the heater drive 24 to supply power to the heating elements 14 to heat the oven chamber 12 as needed. The controller 20 will maintain the oven mode and temperature set point until the user interface 18 sends an off signal. Once the off signal is received, the controller 20 ends the oven mode operation and stops heating the oven chamber. In an alternative embodiment, the user may select a first oven mode and oven temperature set point and then later select a different oven mode or oven temperature set point instead of selecting the off key. In this embodiment, the oven returns to step 32 and performs the following steps for the newly selected oven mode or oven temperature set point.

The present invention relates to oven temperature control. According to the invention, the controller 20 performs instructions to achieve high precision temperature control of the oven chamber 12. Briefly, the controller 20 executes a time-based algorithm. The controller 20 directs the heater drive 24 to apply and remove power to the heating elements 14 for certain periods of time. The inventive method differs from the conventional trip-point method that monitors the temperature sensor 16 and removes power when the oven temperature reaches the trip-point temperature and applies power when the temperature sensor 16 reads a lower temperature than the trip-point. The inventive time-based algorithm breaks away from the dependence on small fluctuations in the temperature sensor signal to determine when to apply power. In the present invention, the controller 20 uses the trend of the temperature sensor signal to calculate a percentage of time to apply heat to control the temperature of the oven chamber 12. With this approach, the percentage of heating time is treated like an analog input allowing the controller 20 to implement sophisticated techniques from control system theory.

In one embodiment of the invention, the control algorithm implemented by the controller 20 is a proportional-plus-integral-plus-derivative (PID) regulator. The following equation represents the PID regulator used to calculate a percentage of output:

$$\text{Output } (\%)=K_p\cdot[e+T\cdot K_1\Sigma e+(K_D\cdot\Delta e)/T]$$

e=error=temperature set point−temperature sensor reading

T=time between temperature sensor readings $K_p$=proportional parameter $K_1$=integral parameter $K_D$=derivative parameter Output is clamped to the range of 0%–100%.

This PID equation has three terms: 1) proportional (e)—an error or difference between the temperature set point and the sensor temperature reading; 2) integral (Σe)—an accumulation of the error over time; and 3) derivative (Δe)—the change of the error (new error−last error). These terms are weighted by the proportional, integral and derivative parameters and are summed to determine the percentage of output needed from the heating element(s) 14. The proportional, integral and derivative parameters are adjusted to optimize rise time, overshoot and responses to disturbances such as an opened oven door. These parameters may be tuned and optimized using computer simulations for the oven. In one embodiment for the bake mode, $K_p$=2.0, $K_1$=0.015 and $K_D$=3.5 for a time period (T) of thirty seconds. In one embodiment, the memory 28 stores parameter values for each oven mode. The controller 20 obtains the parameter values from memory 28 after determining the operating mode from the user interface signals.

In the above PD equation, the integrator term (Σe) is a continual summation of the error at each interval of time (T). To prevent the integrator from running out of control when the oven temperature is far from the desired temperature set point, the controller 20 clears the integrator to zero whenever the output is 0% or 100%. As the oven temperature approaches the temperature set point, the output becomes an intermediate value and the integrator is allowed to accumulate the error.

The controller 20 uses the output value calculated with the above PID regulator equation to determine when to signal the heater drive 24 to provide power to the heating element(s) 14. The output value from the PID regulator equation corresponds to a percentage of time heat should be applied within the oven chamber 12. In one embodiment, the controller 20 signals the heater drive 24 to provide power to the heating element(s) 14 from the power source 26 for the output percentage of time for each fixed cycle period. For example, if the typical cycle period is 60 seconds and the percentage output calculated with the above PID equation is 50%, the controller 20 signals the heater drive 24 to provide power to the heating elements 14 for 30 seconds of the 60 seconds cycle.

As known to those of ordinary skill in control theory, alternatives exist in control theory for the output equation above. In an alternative embodiment, the output value or percentage of time heat should be applied within the oven chamber may be calculated using only the proportional and integral (PI) elements. Moreover, other control theory applications may be applied to obtain the output value as known to those skilled in the art.

Many conventional household ovens use heater "profiles" to improve cooking quality. An example of a heater profile is the use of multiple heating elements 14 to control effects such as the browning of food. The typical profile consists of the amount of time in seconds to supply power to each heating element for each heating cycle and the sequence in which the heating elements turn on and off. Executing the profiles create difficulties because a straight forward duty cycle approach with a fixed cycle period and a varying on-time for the heater cycle is difficult to apply for profiles. The profile performance may not translate properly when adjusted proportionally, and the fast relay switching of the heater drive 24 for low power output may be undesirable because of the audible clicking and greater timing performance needed from the microcomputer.

To address the desire for profile performance, one embodiment of the invention fixes the time power is supplied to the heating elements 14 ("on-time") according to the profile and varies the time power is withheld from the heating units 14 ("off-time"). The on-time for the profile is chosen as a compromise between short durations to reduce the temperature amplitude and longer durations to extend relay contact life. The off-time is calculated by the controller 20 every time period T using the percentage output value (calculated above with the PID equation) and the following equation:

$$\text{Off-time}=[\text{on-time}\cdot 100/\text{output}(\%)]-\text{on-time}.$$

If the percentage output is 100%, the off-time is zero, which means the heater profile repeats without pause. If the percentage output is 0%, the off-time is infinity; the controller handles the zero output as a special case keeping the heating elements 14 off until the output value becomes non-zero.

Figure 3:
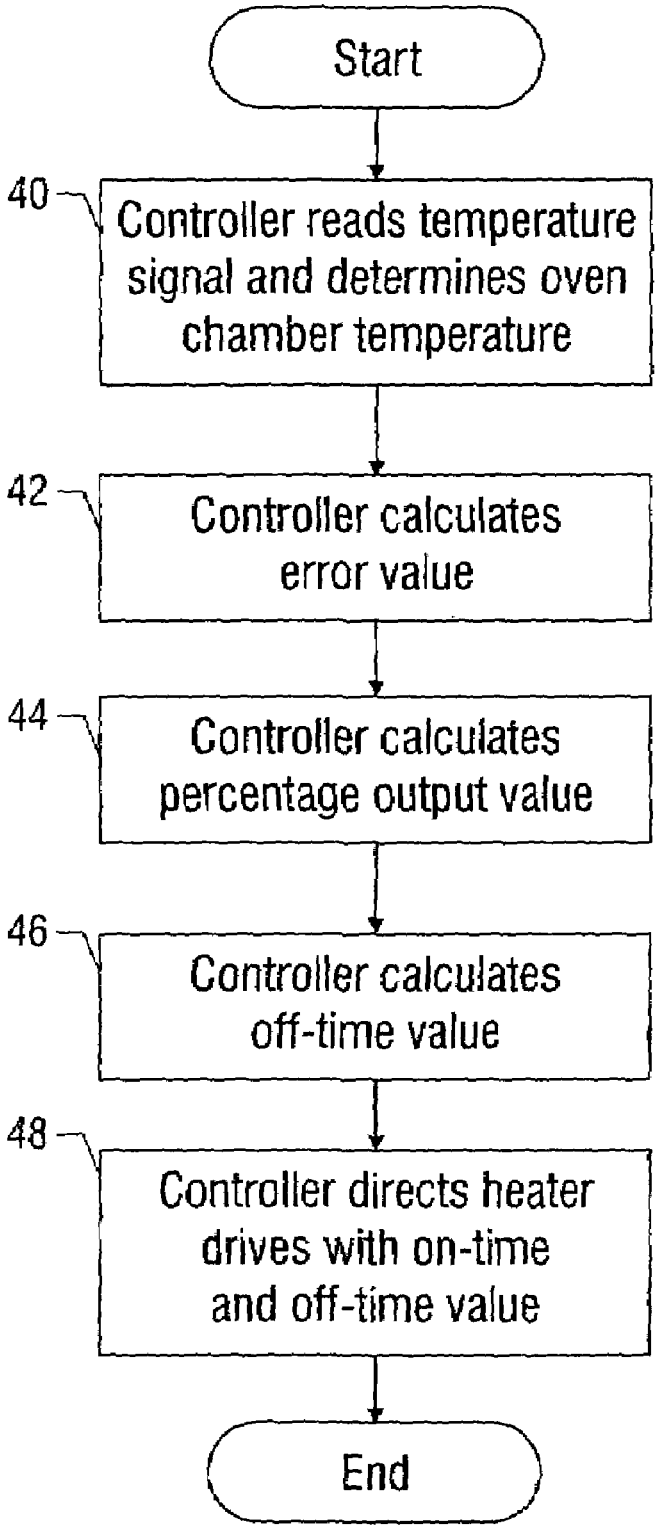
FIG. 3 is a flowchart of the operation of the oven temperature control according to one embodiment of the present invention.

FIG. 3 illustrates the operation of the controller 20 executing the time-based algorithm to maintain the oven chamber 12 at the desired temperature set point. For example, the controller 20 heats and maintains the oven chamber at 350° F. for the baking mode. First at step 40, the controller 20 reads the temperature signal from the temperature sensor 16 and determines the temperature of the oven chamber 12. Next at step 42, the controller 20 calculates the error by taking the difference between the temperature set point and temperature value determined from the temperature signal. Using the calculated error value, the controller calculates the percentage output value at step 44 using the PID equation discussed above. The controller 20 uses the parameter values retrieved from the memory 28 for the selected oven mode. Once the percentage output value is calculated, the controller 20 calculates the off-time value at step 46 using the equation discussed above. Using the off-time value, the controller 20 directs the heater drive 24 to supply power to the heating elements 14 for the predetermined on-time and withhold power from the heating elements 14 for the calculated off-time at step 48. The controller repeats steps 40 through 48 for each cycle period.

Figure 4:
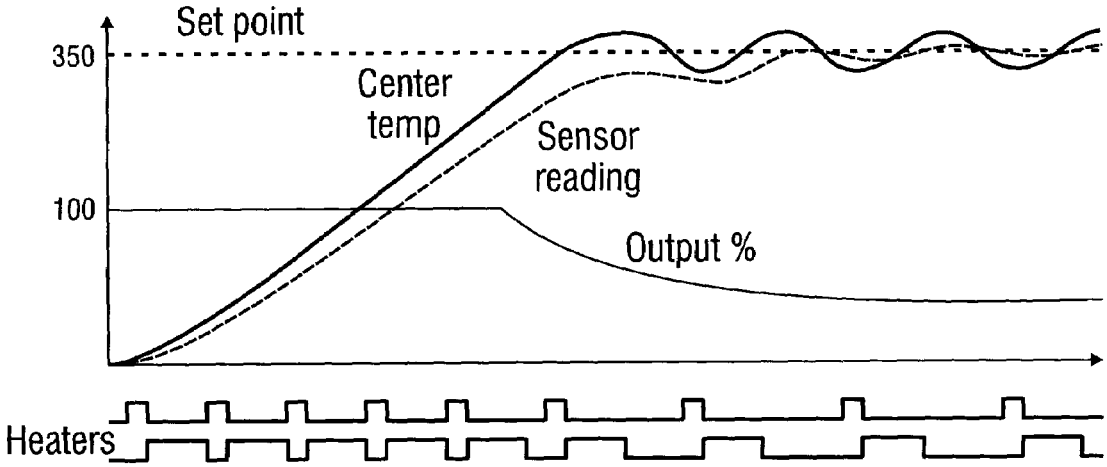
FIG. 4 is a graph of an example performance of the oven temperature control.

FIG. 4 illustrates a graph of the performance of the oven temperature control. For the example of FIG. 4, the controller 20 is operating the oven in bake mode at a temperature set point of 350° F. The controller 20 is also executing a profile that includes two heating elements 14, An upper heating element is supplied with power for an on-time of 10 seconds and then a lower heating element is powered with an on-time of 50 seconds. The graph of FIG. 4 illustrates the actual temperature of the center of the oven chamber 12 and the temperature provided by the temperature sensor 14. The temperature sensor reading is intentionally shown to lag behind the actual temperature of the center of the oven chamber. This lagging effect may be compensated for by optimizing the P, I and D parameters. FIG. 4 also illustrates the calculated percentage output value using the PID equation above. The inventive oven control maintains the temperature within a small range of the desired temperature set-point.

While the present invention has been described with reference to one or more preferred embodiments, those skilled in the art will recognize that many changes may be made thereto without departing from the spirit and scope of the present invention.

What is claimed is:

1. A control system for controlling an appliance at a predetermined temperature comprising:

a sensor capable of providing a temperature signal representative of a temperature in the appliance;

a controller capable of receiving the temperature signal, determining a time period to apply power to a heating element of the appliance, determining an error value representing the difference between a sensed temperature provided by the temperature signal and the predetermined temperature, and determining a percentage of the predetermined time period based on the error value to apply power to the heating element.

2. The control system of claim 1 further comprising an analog to digital converter, wherein the temperature signal is converted to a digital signal, wherein the controller periodically determines the error value and the controller determines a sum of the error values, and wherein the controller determines the percentage of time to apply power of the predetermined time period based on the sum of the error value.

3. The control system of claim 1 further comprising an analog to digital converter, wherein the temperature signal is converted to a digital signal, wherein the controller periodically determines the error value and the controller determines a rate of change of the error values, and wherein the controller determines the percentage of time to apply power for the predetermined time period based on the rate of change of the error values.

4. The control system of claim 1 further comprising an analog to digital converter, wherein the temperature signal is converted to a digital signal, wherein the controller periodically determines the error value and the controller determines a sum of the error values and a rate of change of the error values, and wherein the controller determines the percentage of time to apply power for the predetermined time period based on the error value, the sum of the error values and the rate of change of the error values.

5. A method for controlling an appliance at a predetermined temperature, the method comprising the steps of:

determining an appliance temperature;

calculating a difference between the predetermined temperature and the appliance temperature;

determining a time period during which power is to be applied;

calculating a percentage output value using the difference; and supplying power to the appliance for a percentage of time equal to the percentage output value of the predetermined time period.

6. A control system for controlling an appliance at a predetermine temperature comprising:

a sensor capable of providing a temperature signal representative of a sensed temperature in the appliance;

a first heat element capable of providing heat in the appliance when supplied with power during each of a plurality of heating cycles;

a controller capable of receiving the temperature signal and determining an off time period during which power is not applied to the first heating element based a difference between the sensed temperature and the predetermined temperature for each of the plurality of heating cycles;

the controller outputting signals to apply power to the first heating element for a predetermined fixed on time period and to withhold power from the first heating element for the determined off time period during each of the plurality of heating cycles.

7. The control system of claim 6 wherein the controller implements a proportional-plus-integral-plus-derivative regulator to determine the off-time.

8. The control system of claim 6 further including a second heating element, the controller executing a profile by supplying power to the first heating element for the predetermined fixed on time and supplying power to the second heating element for a second predetermined fixed on time, the controller determining a second off time period during which power is not applied to the second heating element based the difference between the sensed temperature and the predetermined temperature for each of the plurality of heating cycle.

* * * * *